United States Patent [19]

Ellis et al.

[11] 3,999,361

[45] Dec. 28, 1976

[54] METHOD OF AND APPARATUS FOR FORMING A MULTI-PLY YARN

[75] Inventors: Basil Carmont Ellis, Airey's Inlet; Robert Tippett, Highton, both of Australia

[73] Assignee: Commonwealth Scientific and Industrial Research Organization, Campbell, Australia

[22] Filed: Apr. 17, 1975

[21] Appl. No.: 569,114

[30] Foreign Application Priority Data

Apr. 19, 1974 Australia ..... 7305/74

[52] U.S. Cl. ..... 57/34 AT; 57/77.42; 57/156

[51] Int. Cl.[2] ..... D02G 3/00; D01H 7/92

[58] Field of Search ..... 57/34 AT, 77.4, 77.42, 57/156, 106

[56] References Cited

UNITED STATES PATENTS

| | | | |
|---|---|---|---|
| 3,225,533 | 12/1965 | Henshaw | 57/34 AT |
| 3,306,023 | 2/1967 | Henshaw et al. | 57/34 AT |
| 3,443,370 | 5/1969 | Walls | 57/34 AT |
| 3,468,120 | 9/1969 | Heldebrand | 57/34 AT |
| 3,577,873 | 5/1971 | Waters | 57/34 AT |
| 3,717,988 | 2/1973 | Walls | 57/34 AT |

FOREIGN PATENTS OR APPLICATIONS

| | | | |
|---|---|---|---|
| 1,292,053 | 4/1969 | Germany | 57/77.42 |
| 376,461 | 1964 | Switzerland | 57/77.42 |

*Primary Examiner*—James J. Gill
*Assistant Examiner*—Charles Gorenstein
*Attorney, Agent, or Firm*—Sughrue, Rothwell, Mion, Zinn & Macpeak

[57] ABSTRACT

A two-stage "self-twist" process and apparatus for forming a multi-ply twisted strand assembly in which in the second stage alternating twist is applied to a first travelling assembly by intermittently lifting it in and out of a twisting nip, the travelling assembly being then converged with a second assembly so that the two twist together to form a stable twisted structure.

10 Claims, 9 Drawing Figures

METHOD OF AND APPARATUS FOR FORMING A MULTI-PLY YARN

The present invention relates to the production of a stable yarn of the "self-twist" variety.

Australian Pat. Specification No. 260,092 describes the formation of a stable multi-strand yarn by first developing alternating zones of opposite twist in a travelling strand and then stabilizing the twist by converging the strand with another strand and allowing it to twist around the other strand. A yarn formed in this manner is known as a "self-twist" yarn.

Developments of this arrangement are disclosed, inter alia, in Australian Pat. Specification Nos. 288,664 and 404,827. In the arrangement described in the latter specification, a strong yarn having at least three separate strands is formed in a two-stage "self-twist" process comprising the steps of individually twisting a first strand so that the first strand has repeated along its length successive zones of opposite twist, converging the first strand with a second strand so that the strands twist around one another such as to form a stable first yarn having successive zones of opposite plying twist, twisting said first yarn to superimpose alternately opposite twist in successive zones along its length, and converging the twisted first yarn with a second yarn or further strand so that the two twist around one another to form a stable twisted assembly.

The process of Specification No. 405,827 has proven particularly adaptable to the production of composite yarns in which one or more natural fibre strands are twisted together with one or more synthetic filamentary strands but has suffered somewhat in efficiency from the bulky and cumbersome nature of the equipment employed thus far. Access for maintenance and rethreading has also proven undesirably difficult and time consuming.

It is an object of the present invention to provide an improved method of and apparatus for forming a yarn having at least three strands twisted together which utilizes a modified two-stage "self-twist" process derived from the process disclosed in Specification No. 405,827. Throughout this specification, the phrase "strand assembly" is intended to embrace a single filament or strand.

In essence, the invention is based on the intermittent lifting of a travelling strand from a twisting nip formed between two adjacent oppositely moving surfaces.

In one aspect, the invention provides a process in accordance with the above described two-stage "self-twist" process of Australian Pat. Specification No. 405,827 in which twisting of the first yarn to superimpose alternately opposite twist in successive zones along its length is carried out by passing the first yarn through a nip defined by a pair of twisting surfaces which are moved continuously in opposite directions transversely of the direction of travel of the yarn so as to impart a twist to the yarn at the nip and acting on the yarn to intermittently physically lift it from the nip to permit free passage of the yarn past the nip during the intervals in which the yarn is lifted from the nip, and in which the twisting of the first strand and the intermittent lifting of the latter from the nip are synchronized in dependence on desired characteristics of the final stable twisted assembly. Twisting of said first strand may advantageously have been effected by passing the strand between respective forwardly moving oppositely transversely reciprocating twisting surfaces.

This modified two-stage "self-twist" process has proven particularly well suited to the formation of composite yarns comprising a mixture of natural fiber strands and synthetic filamentary strands. Advantageously, the first strand is a natural fiber strand, the second strand a substantially untwisted synthetic filamentary strand, and the further strand a further substantially untwisted synthetic filamentary strand. It is to be noted that initial observations indicate that no special advantage would be gained by also twisting the filamentary strands.

Specification No. 405,827 also discloses a two-stage "self-twist" apparatus for producing a stable twisted yarn assembly, comprising first twisting means to impart alternating zones of opposite strand twist to a first strand, first converging means adjacent the first twisting means to converge said first strand to form a first yarn, second twisting means to superimpose alternating zones of opposite twist upon the first yarn and second converging means adjacent the second twisting means to converge the first yarn with a further yarn or strand. In accordance with the invention, this apparatus may be modified to provide, an apparatus for producing a stable yarn assembly having at least three strands twisted together, comprising first twisting means to impart alternating zones of opposite strand twist to a first strand, first converging means adjacent the first twisting means to converge said first strand to form a first yarn, a pair of twisting surfaces defining a nip through which the first yarn may be passed and being arranged for movement in opposite directions transversely of the direction of travel of the first yarn so as to impart a twist to the first yarn at the nip, a strand guide for the first yarn disposed adjacent the nip, means to cause the strand guide to execute a cyclic motion by virtue of which the yarn is intermittently lifted from the nip to permit free passage of the yarn past the nip during the intervals in which the yarn is lifted from the nip, second covergence means to converge the first yarn with a further yarn or strand so that the two may twist around one another to form a stable twisted assembly, and means for synchronizing the operation of the first twisting means and the intermittent lifting means in dependence on desired characteristics of the final stable twisted assembly.

The strand guide is preferably situated immediately beyond the nip relative to the direction of travel of the assembly and may define the point at which the two assemblies are converged. Lifting of the assembly from the nip may be effected in any convenient direction and the expression "lifting" is not to be taken as implying only lifting in a vertical direction.

The strand guide may advantageously comprise a V-shaped recess formed in a guide element fashioned in a suitable material and may also define said convergence means.

The pair of surfaces may be comprised of the outer cylindrical surfaces of a pair of rotatable rollers or discs which are mounted for continuous rotation in the same direction.

Throughout this specification reference is made to the "nip" of the twisting surfaces. In current textile terminology the work "nip" is frequently understood to imply that the rollers or like elements which form the nip actually contact one another at the nip position. In this specification it is to be understood that no such limitation filamentary strand, the resultant composite yarn twisted in the said nip being then converged with a further substantially untwisted synthetic filamentary strand constituting the second yarn of the above-described two-stage "self-twist" process. It is to be noted that initial observations indicate that no special advantage would be gained by also twisting the filamentary strands.

Specification No. 405,827 also discloses a two-stage "self-twist" apparatus for producing a stable twisted yarn assembly, comprising first twisting means to impart alternating zones of opposite strand twist to at least one strand of a group of strands, first converging means adjacent the first twisting means to converge the first group of strands to form a first yarn, second twisting means to superimpose alternating zones of opposite twist upon the first yarn and second converging means adjacent the second twisting means to converge the first yarn with a second yarn. The above described apparatus provided by the present invention may advantageously be incorporated as the second twisting means and second converging means of this two-stage "self-twist" apparatus. The means to intermittently lift the strands from the nip is desirably positively connected to the first twisting means to alloy a predetermined synchronisation of the two twisting means.

Throughout this specification reference is made to the "nip" of the twisting surfaces. In current textile terminology with word "nip" is frequently understood to imply that the rollers or like elements which form the nip actually contact one another at the nip position. In this specification it is to be understood that no such limitation is intended and that the expression "nip" is used to include the case where the surfaces each contact the strand which is between them but do not contact one another.

The invention will now be described by way of example with reference to the accompanying drawings in which:-

Figure 1:
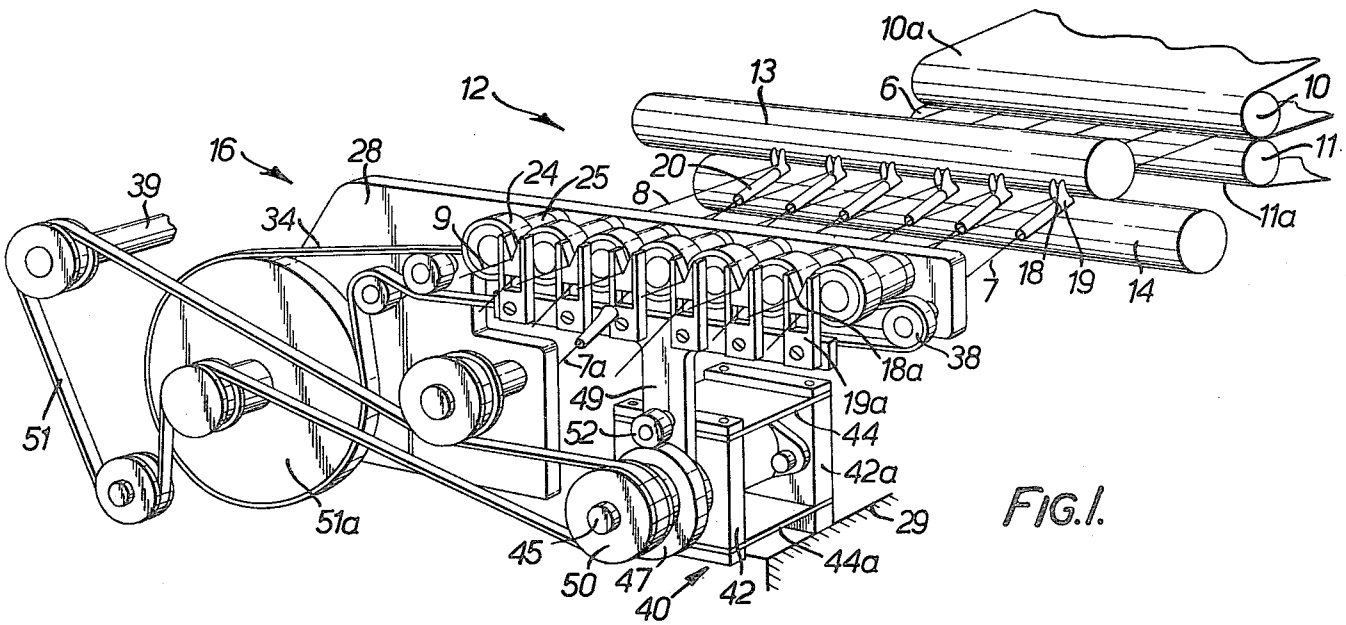
FIG. 1 is a perspective view of a two stage "self-twist" unit incorporating apparatus in accordance with a first embodiment of the invention and illustrating one mode of operation of the process of the invention.
Figure 2:
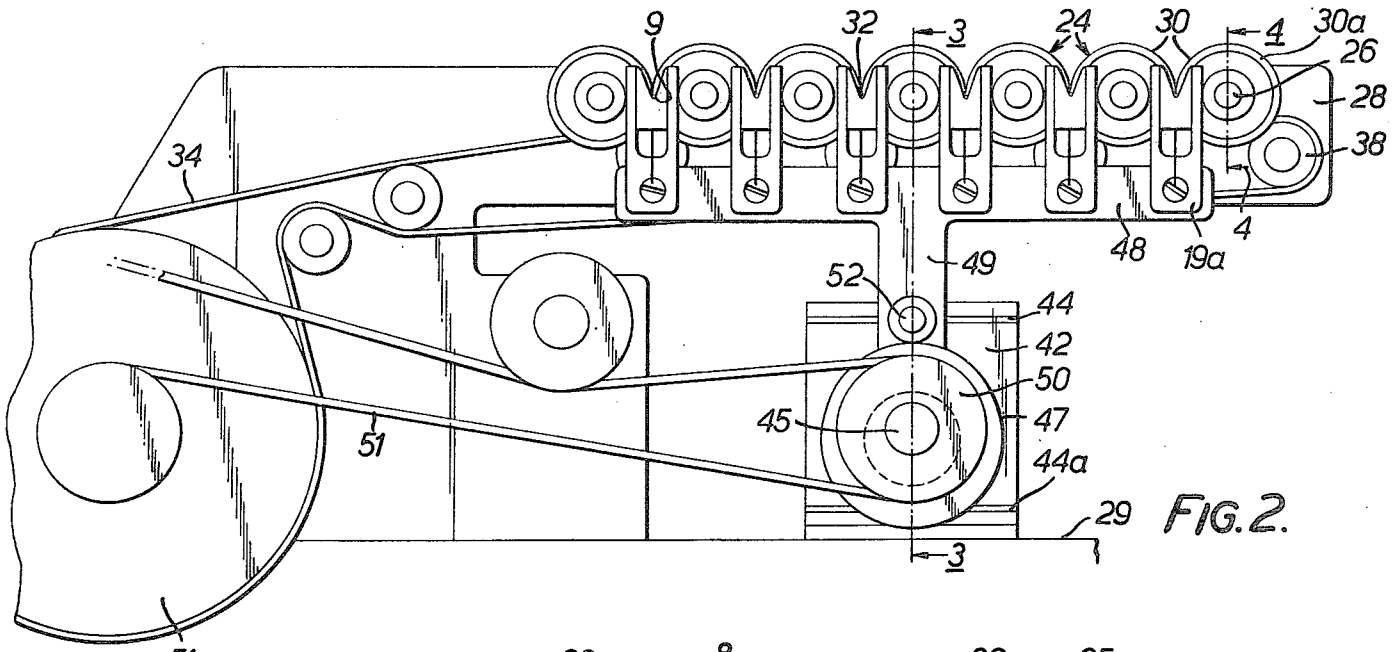
FIG. 2 is a front elevation of part of the unit of FIG. 1.
Figure 5:
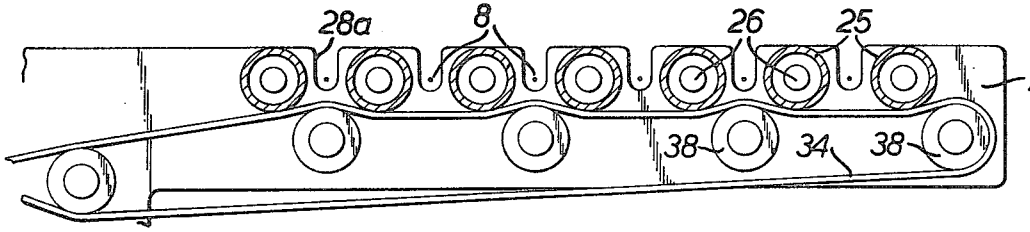
Figure 3:
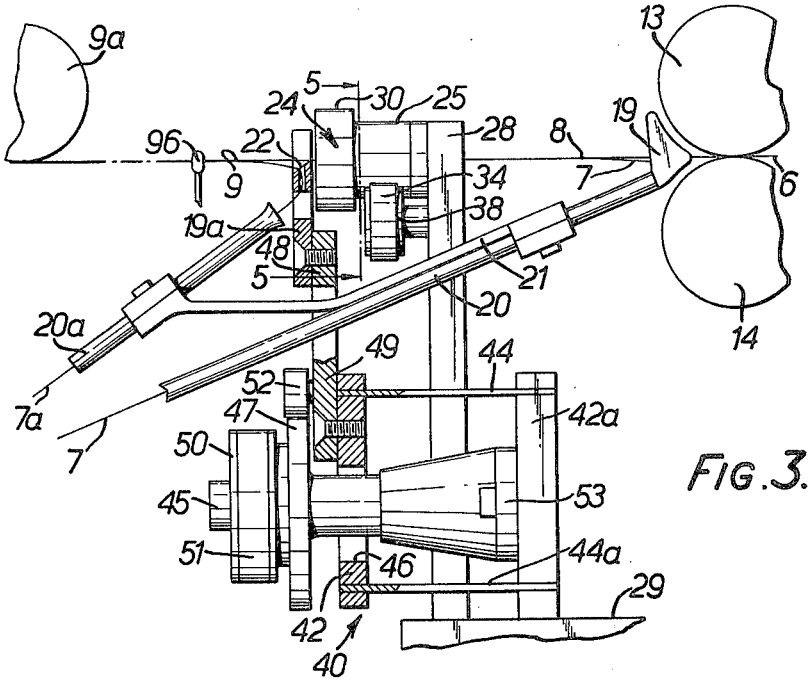
Figure 4:
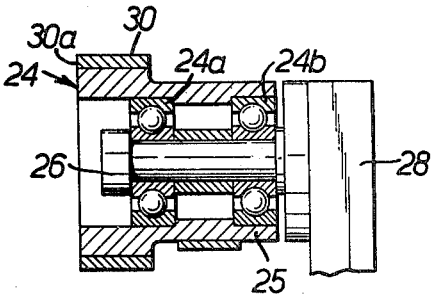
Figure 8:
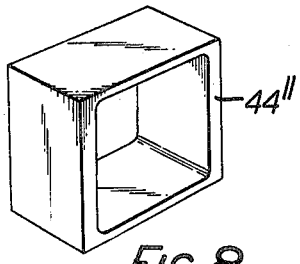
Figure 9:
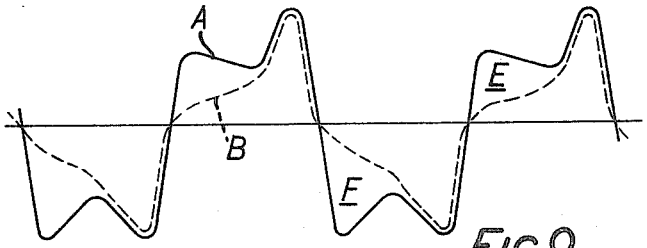
Figure 6:
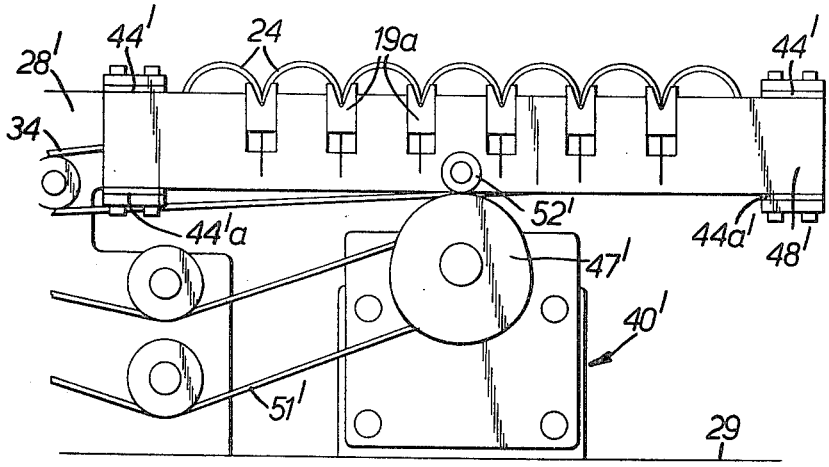
Figure 7:
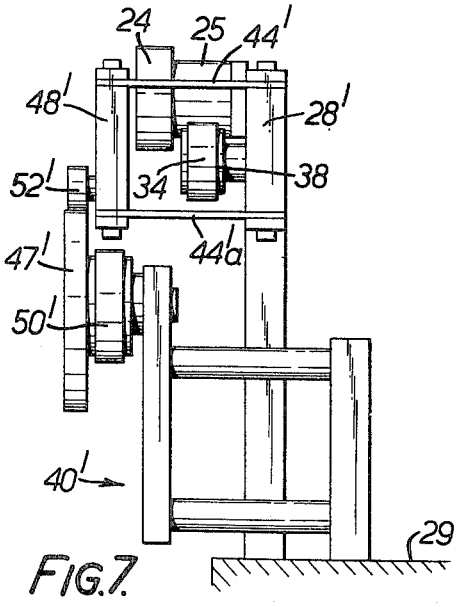

FIGS. 3 and 4 are respective cross-sections on the lines 3—3 and 4—4 of FIG. 2;

FIG. 5 is a cross-section on the line 5—5 of FIG. 3;

FIG. 6 is a front elevation of part of a unit in accordance with a second embodiment with a second embodiment of the invention;

FIG. 7 is a side elevation of the unit of FIG. 6;

FIG. 8 is a perspective of a mounting box incorporated in a modification of the unit of FIGS. 6 and 7; and FIG. 9 shows the twist distributions in a yarn produced by means of the unit of FIGS. 1 to 5 and in a yarn produced by a single-stage twister incorporating only rotating discs and no reciprocating rollers.

The illustrated unit includes a conventional drafting apparatus of which only the final feed rolls 10, 11 and aprons 10*a*, 11*a* are shown, first twisting means 12 comprising a pair of oscillating twisting rollers 13, 14 of the type illustrated in FIGS. 1 to 5 of Pat. Specification No. 288,664 and second twisting means 16 constructed in accordance with the invention. Rollers 13, 14 are elastomer covered and are accurately positioned and loaded so that sufficient pressure exists between them to achieve the required twisting. The rollers are driven so that they reciprocate in opposite phase and rotate in opposite directions whereby their adjacent surfaces move at substantially the same speed in the direction in which a plurality of side by side but spaced and parallel travelling strands 6 are fed forwardly from rollers 10, 11.

Strands 6 pass between the roller and are accordingly so twisted by the twisting surfaces provided by the rollers as to exhibit alternate zones of opposite twist along their lengths. Each of the thus twisted strands 6 passes from the rollers 13, 14 to be converged at convergence guide groove 18 formed in guide element 19 with a continuous filamentary strand 7. Each strand 6 then twists alternatingly in the manner described in Australian Pat. Specification No. 260,092 to form a two-ply yarn 8. Yarn 8 is then intermittently twisted by the second twisting means 16 before being converged with a second continuous filamentary strand 7*a* in a further strand guide groove 18*a* formed in a second guide element 19*a* constituting part of the second twisting means 16. The yarn 8 twists alternatingly about the strand 7*a* to form a stable three-ply assembly 9 in a manner substantially similar to the mode of formation of the yarn 8, before being led onto a suitable take-up package 9*a* by an eye guide 9*b*.

Filamentary strands 7, 7*a* are fed from respective guide tubes 20, 20*a* interiorly of guide elements 19, 19*a* to emerge from small apertures in the guide grooves 18, 18*a*. An aperture 22 in one of the forward guide elements 19*a* is clearly depicted in FIG. 3, as is a frame arm 21 utilized in correctly supporting the air jet tubes 20, 20*a*.

Twisting means 16 includes a plurality of rotating discs 24 rotatably mounted by a pair of ball races 24*a*, 24*b* on respective pins 26 fixed to a bracing web 28 having cut outs 28*a* to receive the travelling yarns 8. (FIG. 4) Discs 24 have flat outer cylindrical surfaces 30 and are so mounted in side by side disposition that the surfaces 30 serve, at their successive points of closest approach, as twisting surfaces defining respective twisting nips 32 through which respective ones of yarns 8 are passed. Surfaces 30 should be finished in an elastomer material 30*a* Discs 24 are rotatable by a belt drive which incorporates an endless friction belt 34 and a set of appropriately disposed belt guide wheels 38 rotatably mounted on bracing web 28. Belt 34 friction drives reduced diameter axial sleeve extensions 25 of discs 24 and is itself driven by means to be described from a drive shaft 39 which also drives the rollers 13, 14.

It will be apparent that discs 24 rotate in the same rotational sense whereby their cylindrical surfaces 30 move, at the nips, in opposite directions transversely of the direction of travel of the associated strands 8 so as to impart a twist to the strands at the nips. One way of imparting to strands 8 the alternately opposite twist necessary for the alternating twist process is to periodically interrupt twisting of the strands at the nips 32. This is achieved in accordance with the invention by intermittently lifting the travelling strands from their respective nip by subjecting the guide elements 19*a* located immediately beyond the nips 32 to an appropriate cyclic motion.

One mechanism for oscillating guide elements 19*a* is depicted in FIGS. 1 to 5 and includes an opensided cube 40 defined in part by rigid vertical end panels 42, 42*a*, and respective upper and lower webs 44, 44*a* fashioned in a resiliently flexible material such as spring steel or a suitable polymer. Guide elements 19*a* are fixed, via a cross beam 48 and a post 49, to panel 42 whilst the cube is in turn mounted on the machine framework by virtue of panel 42*a* being rigidly fixed to a frame member 29. Panel 42*a* also carries a bearing 53 for a shaft 45 which extends through an oversized aperture 46 in the opposite panel 42 and itself carries a belt drive wheel 50 and cam 47 located exteriorly of the cube adjacent panel 42. Cam 47 engages a cam follower 52 mounted on post 49.

Drive wheel 50 is uniformly driven in synchronisation with the discs 24 and rollers 13, 14 from shaft 39 by a second endless friction belt 51 which passes about a number of belt guide wheels including one, 51*a*, which forms part of a speed enhancement coupling for belt 34.

Cam 47 is shaped so that, as the drive wheel, shaft and cam are rotated in unison, the cam follower executes a periodic up and down motion, carrying post 49, panel 42, beam 48 and guide elements 19*a* with it as it does so. Each yarn 8 is thereby periodically lifted from its nip 32 to permit free passage of the yarn past the nip. The aperture 46 in panel 42 must of course be adequate to maintain clearance about shaft 45 during this up and down movement by panel 42. Flexible panels 44 serve to provide a cushioned shock-absorbing mounting for the guide element during its reciprocating movement under the action of the cam. The rise and fall time of the cam mechanism should of course be as short as possible to minimise fibre slippage as the yarns move in and out the nips. Thus, although an eccentric cam would be acceptable, it has been found much more advantageous to employ a shape with a limited rise and fall time. For example, a shape which produces a 144° dwell at both top and bottom of the stroke with a 36° rise and fall has proved highly satisfactory.

Since the reciprocating rollers 13, 14, discs 24, 25 and oscillating guide elements 19*a* are driven from a common shaft 39, synchronisation of the first and second twisting means to obey any desired uniform phase relationship can be achieved. This of course essential if an optimum yarn substantially uniform over its length is to be ultimately produced.

In particular, it is desirable in general to choose a phase difference between the two twisting means which will give, in the final yarn, an optimum twist distribution which balances maximum twist intensity and minimum twist changeover length. It is found, for example, that for a separation between the roller nips and the disc nips of 10cm and a cycle length (that is, the length of output yarn embodying one complete twisting cycle of 22cm, the phase difference between the twisting means, or, more precisely, the phase difference should be adjusted so that the difference between the first and second stage wrap in the final yarn is in the range 115°± 15°.

It will of course be appreciated that the separation of the roller and disc nips must in general be sufficient to provide space for twist storage and a distance approximately equal to one half the cycle length, as defined above, is typically adequate. FIGS. 6 and 7 illustrate an alternative arrangement for effecting cyclic up and down movement of the guide elements 19*a*. In this arrangement, the cross-beam 48' supporting the guide elements is mounted to bracing web 28' by respective pairs of tensioned spring steel webs 44' and 44*a'* which perform a function similar to the webs 44, 44*a* in the embodiment of FIGS. 1 to 5. The open cube 40' now takes the form of a rigid mounting frame for fixedly supporting belt drive wheel 50' and cam 47' which function as before. In this case, however, the cam follower 52' is fixed directly to the cross-beam 48'.

In place of the spring steel webs utilized in resiliently mounting the guide elements 19*a* in the arrangements of FIGS. 1 to 5 and 6 and 7, a single thin walled box formed of a suitable resiliently deformable polymeric material may be used to mount the cross-beam 38 or 38' to bracing web 28 or 28'. Such a box is illustrated at 44'' in FIG. 8.

FIG. 9 shows the twist distributions in a yarn produced by means of the unit of FIGS. 1 to 5 (curve A) and in a yarn obtained from a single-stage unit incorporating only the twisting discs but not the reciprocating rollers.

It is immediately apparent that the two twisting stages interact in a clearly observable manner. From examination of many yarn twist distributions and from observations made at the spinners during trials, it can be postulated that the twisting sequence relating to the second stage twist distribution is approximately as follows:

1. Rollers 13, 14 start delivery of S twist yarns.
2. Yarn enters the nip 32 of twisting discs 24, the guide 19*a* being lowered.
3. Disc output twist and second stage filament wrap is S twist and therefore Z in the zone between the rollers and discs. The rate of twist insertion by the discs in several times greater than that of the rollers and the resulting twist stored in this zone is therefore Z. Because of the negative contribution of the oscillating roller twist, however, the build up of twist in the intermediate zone is not typical of the approach to the steady state of false twisting and the S twist output from the discs does not decay as rapidly as would otherwise be expected (zone E in FIG. 9).
4. The rollers change to a Z twist output.
5. The yarn is lifted clear of the nip between the twisting discs by the adjustable guide 19*a* and the storage of Z twist in the zone between the rollers and discs is gradually fed through the second stage convergence 18*a* producing Z twist second stage filament wrap. This Z twist would normally be expected to decay exponentially but since the output from the oscillating rollers is also Z twist at this time decay is delayed (zone F).

If, however, due to conditions of high torque and/or lack of adequate restraint at the second stage convergence the stored Z twist propagates rapidly instead of feeding through, the distribution becomes excessively skew and the yarn produced is unsuitable for knitting purposes.

It is to be emphasized that the above postulated sequence is by way of suggestion only and is not to be considered in any way binding or limiting upon the scope of monopoly afforded the applicant.

The above described apparatus has a number of important advantages relative to a machine in which both twisting stages comprise reciprocating rollers, such as the arrangement described and illustrated in Specification No. 405,827. A completely open top in the second stage of the twisting operation makes for easy assessibility for threading and maintenance. The complexity of simultaneous rotation and reciprocation is dispensed with and accurate bearings such as air bearings are not required. The twist may be controlled simply by varying the speed of the discs which it itself independent of cycle length. It is also to be noted that the kind of problems which have been found to arise with earlier apparatus on pulling of a strand assembly between elastomeric surfaces is of no significance in the apparatus of the invention. This is due to a greater strength and stability afforded by the synthetic filament.

On comparing a three-ply yarn produced by the illustrated unit with a similar yarn produced on a machine in which both twisting stages comprise a pair of oppositely rotating transversely reciprocating rollers, the applicants have discerned an improvement in overall yarn quality. The yarn might be generally described as being somewhat tidier and to have a lower fault rate and this appears to be related to improved interlocking between the staple fibres and the filamentary strands. The incidence of "strip back," in which the staple fibres slip rearwardly along the filament, is somewhat reduced. With corresponding twisting conditions, a final yarn exhibiting higher twist and shorter twist change-over regions is obtained.

EXAMPLE

Wool of 21$\mu$ and 22 tex was converged 1.0cm beyond the reciprocating roller nip with a filament of nylon 66 and the resultant yarn converged at the front cyclically moveable guide elements with a further filament of nylon 66 to form a final three-ply yarn. The cycle length was 22 cms and the speed of the rotating discs 8,000 revolutions per minute. The front guide elements were displaced 1mm beyond the nip between the discs and a 100$\mu$ gap maintained at this nip. The yarn was drawn at a speed of 300 meters per minute under a tension of 30 grams. The cam was shaped for a symmetrical characteristic having a 36° rise and a 36° fall.

It was found that the two-ply yarn produced at the first twisting stage had a ply twist of 48 twists per half cycle and a twist change-over length of 14.5mm. The final three-ply yarn exhibited a second stage ply twist of 45 twists per half cycle and a change-over length of 14.5 mm. The measured tenacity was 90mnewtons/tex.

We claim:

1. A method of forming a stable yarn assembly having at least three strands twisted together comprising the steps of individually twisting a first strand so that the first strand has repeated along its length successive zones of opposite twist, converging the first strand with a second strand so that the strands twist around one another such as to form a stable first yarn having successive zones of opposite plying twist, twisting said first yarn to superimpose alternately opposite twist in successive zones along its length, and converging the twisted first yarn with a second yarn or further strand so that the two twist around one another to form a stable twisted assembly wherein the twisting of the first yarn is carried out by passing the first yarn through a nip defined by a pair of twisting surfaces which are moved continuously in opposite directions transversely of the direction of travel of the yarn so as to impart a twist to the yarn at the nip and engaging the yarn intermittently with means to physically lift it from the nip to permit free passage of the yarn past the nip during the intervals in which the yarn is lifted from the nip, and wherein the twisting of the first strand and the intermittent lifting of the first yarn from the nip are synchronized in dependence on desired characteristics of the final stable twisted assembly.

2. A method according to claim 1 wherein twisting of said first strand is effected by passing the strand between respective forwardly moving oppositely transversely reciprocating twisting surfaces.

3. A method according to claim 1 wherein the first strand is a natural fiber strand, the second strand a substantially untwisted synthetic filamentary strand and the further strand a further substantially untwisted synthetic filamentary strand.

4. Apparatus for producing a stable yarn assembly having at least three strands twisted together, comprising first twisting means to impart alternating zones of opposite strand twist to a first strand, first convergence means adjacent the first twisting means to converge the first strand with a second strand to form a first yarn, a pair of twisting surfaces defining a nip through which the first yarn may be passed and being arranged for movement in opposite directions transversely of the direction of travel of the first yarn so as to impart a twist to the first yarn at the nip, means to intermittently lift the first yarn from the nip to permit free passage of the yarn past the nip during the intervals in which the yarn is lifted from the nip and to converge the first yarn with a further yarn or strand so that the two may twist around one another to form a stable twisted assembly; said means to intermittently lift the yarn from the nip comprises a strand guide disposed adjacent the nip, means for causing the guide to execute a cycle motion by virtue of which the yarn is intermittently lifted from the nip and means for synchronizing the operation of the first twisting means and the intermittent lifting means in dependence on desired characteristics of the final stable twisted assembly.

5. Apparatus according to claim 4 wherein the means to converge the first yarn with a further yarn or strand also comprises said strand guide.

6. Apparatus according to claim 4, wherein the pair of surfaces is comprised of the outer cylindrical surfaces of a pair of rotatable rollers or discs which are mounted for continuous rotation in the same direction.

7. Apparatus according to claim 4 wherein the first twisting means comprises a pair of forwardly moving oppositely transversely reciprocating twisting surfaces defining a twisting nip between them.

8. Apparatus for producing a stable yarn assembly having at least three strands twisted together, comprising first twisting means to impart alternating zones of opposite strand twist to a first strand, first converging means adjacent the first twisting means to converge said first strand with a second strand to form a first yarn, a pair of twisting surfaces defining a nip through which the first yarn may be passed and being arranged for movement in opposite directions transversely of the direction of travel of the first yarn so as to impart a twist to the first yarn at the nip, a strand guide for the first yarn disposed adjacent the nip, means to cause the strand guide to execute a cyclic motion by virtue of which the yarn is intermittently lifted from the nip to permit free passage of the yarn past the nip during the intervals in which the yarn is lifted from the nip, the strand guide also serving to converge the first yarn with a further yarn or strand so that the two may twist around one another to form a stable twisted assembly and means for synchronizing the operation of the first twisting means and the intermittent lifting means in dependence on desired characteristics of the final stable twisted assembly.

9. Apparatus according to claim 8 wherein the pair of surfaces is comprised of the outer cylindrical surfaces of a pair of rotatable rollers or discs which are mounted for continuous rotation in the same direction.

10. Apparatus according to claim 8 wherein the first twisting means comprises a pair of forwardly moving oppositely transversely reciprocating twisting surfaces defining a twisting nip between them.

* * * * *